US005409180A

United States Patent [19]

Stewing

[11] Patent Number: 5,409,180

[45] Date of Patent: Apr. 25, 1995

[54] CABLE DRUM WITH A DEVICE FOR CLAMPING A START END OF A CABLE REELED-UPON THE CABLE DRUM

[75] Inventor: Albert Stewing, Dorsten, Germany

[73] Assignee: Stewing Kunststoffbetrieb GmbH, Dorsten, Germany

[21] Appl. No.: 904,102

[22] Filed: Jun. 24, 1992

[30] Foreign Application Priority Data

Jun. 26, 1991 [DE] Germany ..... 9107854 U
Jun. 26, 1991 [DE] Germany ..... 9107856 U

[51] Int. Cl.[6] ..... B65H 75/14

[52] U.S. Cl. ..... 242/584; 242/587.2; 242/614.1

[58] Field of Search ..... 242/117, 125, 125.1, 242/125.2, 96, 579, 580, 584, 587.2, 614.1, 580.1, 585, 118.31

[56] References Cited

U.S. PATENT DOCUMENTS

| | | | |
|---|---|---|---|
| 1,456,108 | 5/1923 | Johannesen | 242/125.2 |
| 2,193,407 | 3/1940 | Hagen | 242/117 |
| 3,033,487 | 5/1962 | Walker | 242/125.2 |
| 3,572,599 | 3/1971 | Hilmer | 242/117 |
| 3,625,451 | 12/1971 | Anderson | 242/125.1 |
| 4,901,939 | 2/1990 | Obst et al. | 242/117 |

FOREIGN PATENT DOCUMENTS

| | | | |
|---|---|---|---|
| 2701839 | 7/1978 | Germany | 242/125.1 |
| 3712680 | 10/1988 | Germany | 242/117 |
| 55-48165 | 4/1980 | Japan | 242/117 |
| 55-123859 | 9/1980 | Japan | 242/117 |
| 1148949 | 4/1969 | United Kingdom | 242/117 |
| 0637319 | 12/1978 | U.S.S.R. | 242/117 |

*Primary Examiner*—Daniel P. Stodola
*Assistant Examiner*—John Q. Nguyen
*Attorney, Agent, or Firm*—Anderson Kill Olick & Oshinsky

[57] ABSTRACT

A cable drum with a drum hub and two drum disks, where at least one the two drum disks has a cable passage aperture in the region of the drum hub for passing the starting end of the cable to be reeled up through it and has externally a cable clamping device spaced radially from the cable passage aperture for attaching the start end of the cable, at least one of the two drum disks having attachment holes distributed across the circumference for securing the drums in position for transportation purposes, and wherein each drum disk comprises external radially extending stiffening ribs having a height defining an outer surface of the disk and each rib further including a region having a greater height than the outer surface of the disk adapted to prohibit sliding, skidding, and rotating when said region engages a support surface.

13 Claims, 6 Drawing Sheets

CABLE DRUM WITH A DEVICE FOR CLAMPING A START END OF A CABLE REELED-UPON THE CABLE DRUM

BACKGROUND OF THE INVENTION

The invention deals with a cable drum with a drum hub and drum disks. Within the boundaries of the invention, we are dealing preferably with a disassemblable cable drum of plastic material where the drum hub is subdivided into half shells. The half shells are connected with each other and with the rims of the hubs by means of groove/spring devices at the internal side of the drum disks. The drum disks are braced by means of tie rods arranged in the drum core with simultaneous clamping together of the half shells.

In such cable drums there exists a ubiquitous problem, on the one hand, in the fixation or attachment of the start end of a cable to be reeled up and, on the other hand, in the fixation or attachment of the terminal end of the coiled or reeled up cable. Thus, devices suitable for a sound attachment of cable start and cable end do not exist as a rule.

SUMMARY OF THE INVENTION

Accordingly, it is an object of the present invention to provide a cable drum of this type, where the start of a cable to be reeled up and the end of a cable which has already been reeled up can always be soundly attached.

Pursuant to this object, and other which will become apparent hereafter, one aspect of the present invention resides in a cable drum in which at least one of the two drum disks comprises a cable passage aperture in the region of the drum hub for passing the starting end of a cable to be reeled up. Also, externally, with radial spacing from this cable passage aperture, the disk has a cable clamping device for holding the starting end of the cable.

This assures that the starting end of the cable to be reeled up can be soundly attached on the outer side of the cable drum.

The cable passage aperture is preferably disposed in axial projection directly above the drum hub, does not cover the drum hub and extends as an elongated hole with a predetermined width and length in the circumferential direction of the drum disk. Herein the configuration of the elongated hole, as far as width and length are concerned, is determined so that cables of any desired diameter, in any case to the extent that they are available in actual practice, can be passed through.

According to a further embodiment of the invention, which has independent significance, the clamping device is configured as a clamping rib extending in the circumferential direction with a V-shaped clamping recess extending in the radial direction, whose V-legs comprise a barb-like set of teeth. A V-shaped clamping recess provided with teeth of this type is surprisingly suitable for durable clamping and consequently for sound attachment of the respective starting cable end, and this indeed taking again different cable diameters into account. The V angle of the clamping recess amounts preferably to 60°, basically however it can be also made smaller or larger. Only for precautionary reasons the drum disk involved comprises cable binding or tie-off penetrations arranged in pairs radially spaced from the cable clamping device, in order to thus be able to additionally fasten the starting end of the cable by means of a cable binder or tie-off on the external side of the drum disk.

In still another embodiment of the invention with independent significance, cable binding penetrations, disposed in pairs and distributed across the circumference at predetermined spacings, are allocated in the edge region of at least one of the two drum disks, in order to be able to attach the respective cable end of the reeled up cable soundly by means of a cable binder on the internal side of the drum disk. The distribution of the cable binding penetrations arranged in pairs across the circumference of the drum disk enables a sound attachment of the cable ends involved in any position, meaning without requiring shortening of the cable. All the cable binder penetrations are expediently configured as radially extending elongated holes at predetermined spacings from one another in order, on the one hand, to receive between themselves the cable start or cable end involved, and on the other hand, to permit the cable binder to be threaded with sufficient freedom of manipulation into the cable binding penetrations to wrap the binder around the cable start or the cable end to be able to lock the same.

Another problem existing with cable drums is the security for transportation purposes, because the cable drums tend to skid or slide on the loading surface of the transportation vehicles. This occurs especially if the transportation is performed by trucks, because the loading surfaces of trucks do not offer any stable support. The danger of skidding or sliding is particularly great, if the cable drums are stacked one upon the other. Naturally one always tends to transport as many cable drums as possible and therefore one attempts to stack the cable drums which, as such, are stackable. Another problem is that the cable drums resting on one of their cable disks can as a rule be handled by the fork prongs of a forklift only with great difficulty because the ground clearance required for the fork prongs is to that extent lacking. The loading of the cable drums however necessitates the use of forklifts, be it at the storage location or at the user site.

Consequently, the invention has the additional objective of providing a cable drum of the previously described embodiments, which can be soundly secured, especially for transportation and storage purposes, and is in addition eminently suited for forklift loading and handling.

This objective is solved in the invention by providing at least one of the two drums disks, preferably both drum disks, of the cable drum with attachment holes distributed across the circumference of the edge region for securing the drum in position. These attachment holes, which as a rule are bores, enable nailing to the respective storage or loading surface especially also nailing onto boards in the truck bed for transportation. To that extent the attachment holes are, as it were, holes for nails.

According to yet another embodiment of the invention, the drum disks comprise externally at least radially extending stiffening ribs having partial localized increases in the height of these ribs. These increases in the height of the ribs constitute a skidding- and rotational security, because when the cable drums are stacked one upon another they engage in between the stiffening ribs of the cable drum located above or below. Apart from that, the increase in rib height provides an adequate spacing from the respective storage or support face, so that the fork prongs of a forklift can reach easily beneath the stored cable drum and can lift and store it.

According to still another embodiment of the invention, the drum disks, in addition comprise external cams protruding beyond the height of the stiffening ribs. These cams, similarly to the increased height of the ribs, provide skidding and rotational or turning security and spacer elements which enable the prongs of the forks of a forklift to be driven beneath the drums. Preferably, the cams are at least partially integrated into the stiffening ribs. However, they can also be arranged in between the stiffening ribs, indeed in the core- or hub-area as well as in the edge region of the drum disks. In to another embodiment, the cams are integrated into stiffening webs connecting the radial stiffening ribs in the circumferential direction.

According to a further embodiment of the invention having independent significance, the two drum disks, viewed in axial projection direction, comprise water drainage holes or bores within the hub region. This especially takes care of rainwater drainage from the drum core.

The advantages achieved in the invention are essentially that a cable drum is realized, which assures sound fastening of the starting of the cable end as well as of the terminal end of the cable to be respectively reeled up or on the other hand already reeled up cable, and this in a simple and functionally correct manner. At the same time a cable drum is provided which is distinguished by loading security, security against sliding and security against rotation or turning and consequently is eminently suitable for storage and transportation purposes, without the danger of slipping out of place existing. This is important especially for transportation purposes, because in these cases a sound loading has to be assured. In addition to this the cable drum in the invention can now be easily manipulated by a forklift and is distinguished by water drainage from the core area.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
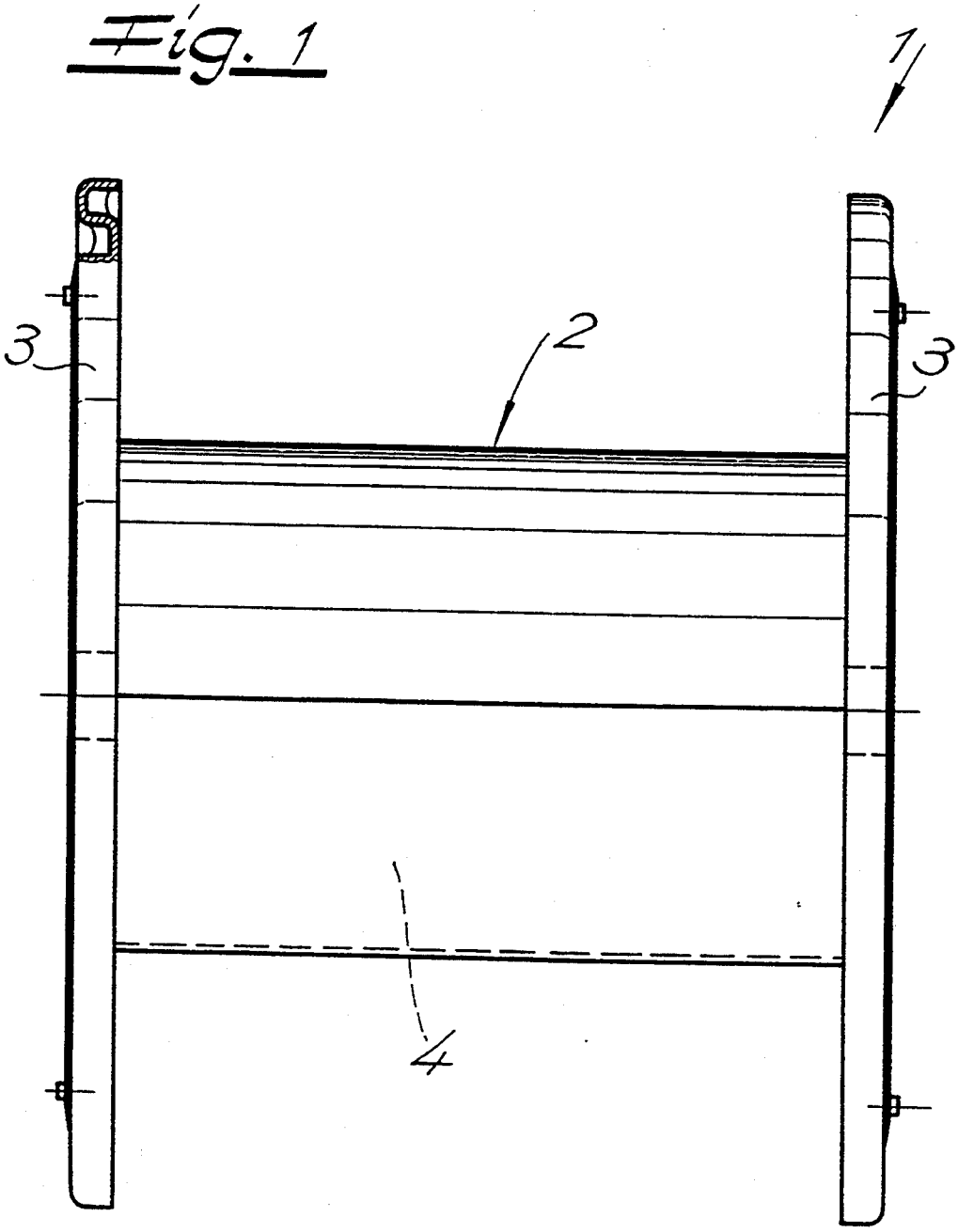
FIG. 1 shows a cable drum according to the invention in a rolling direction.
Figure 2:
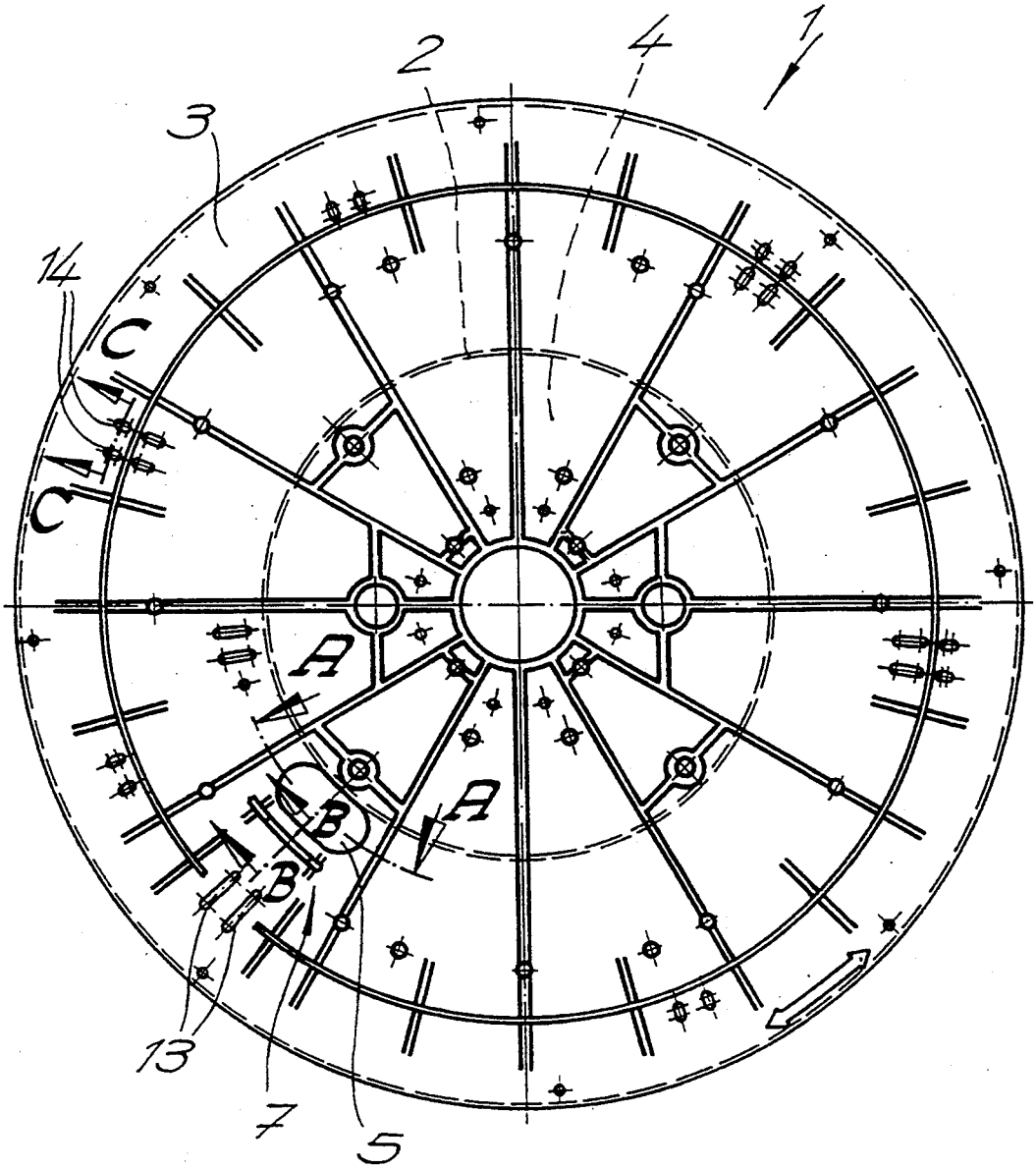
FIG. 2 is a side view of the drum in FIG. 1.
Figure 3:
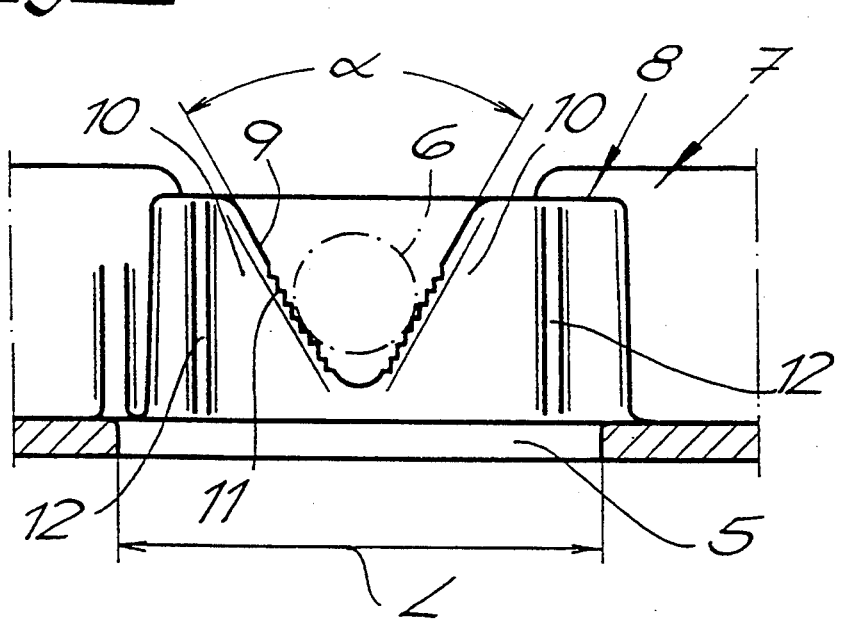
FIG. 3 is a section A—A through the drum in FIG. 2.
Figure 4:
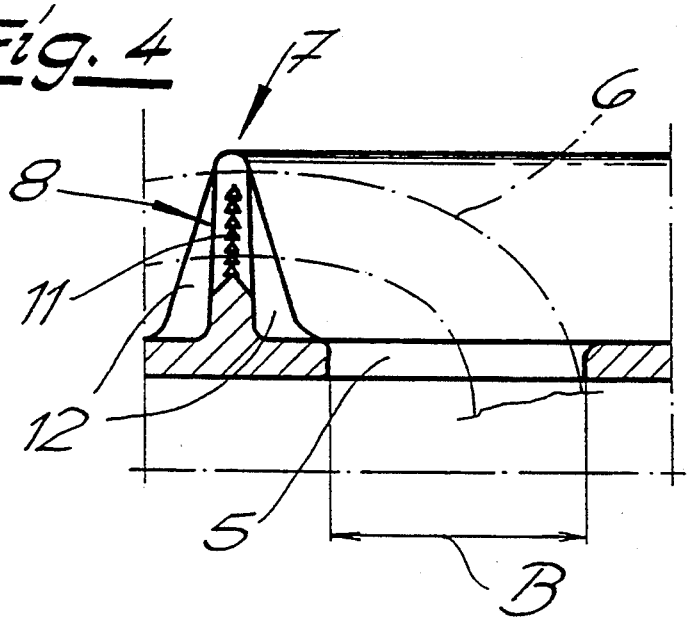
FIG. 4 is a section B—B through the drum in FIG. 2.
Figure 5:
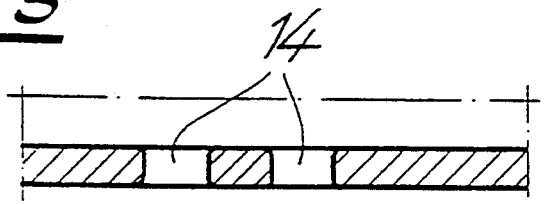
FIG. 5 is a section C—C through the drum in FIG. 2.
Figure 6:
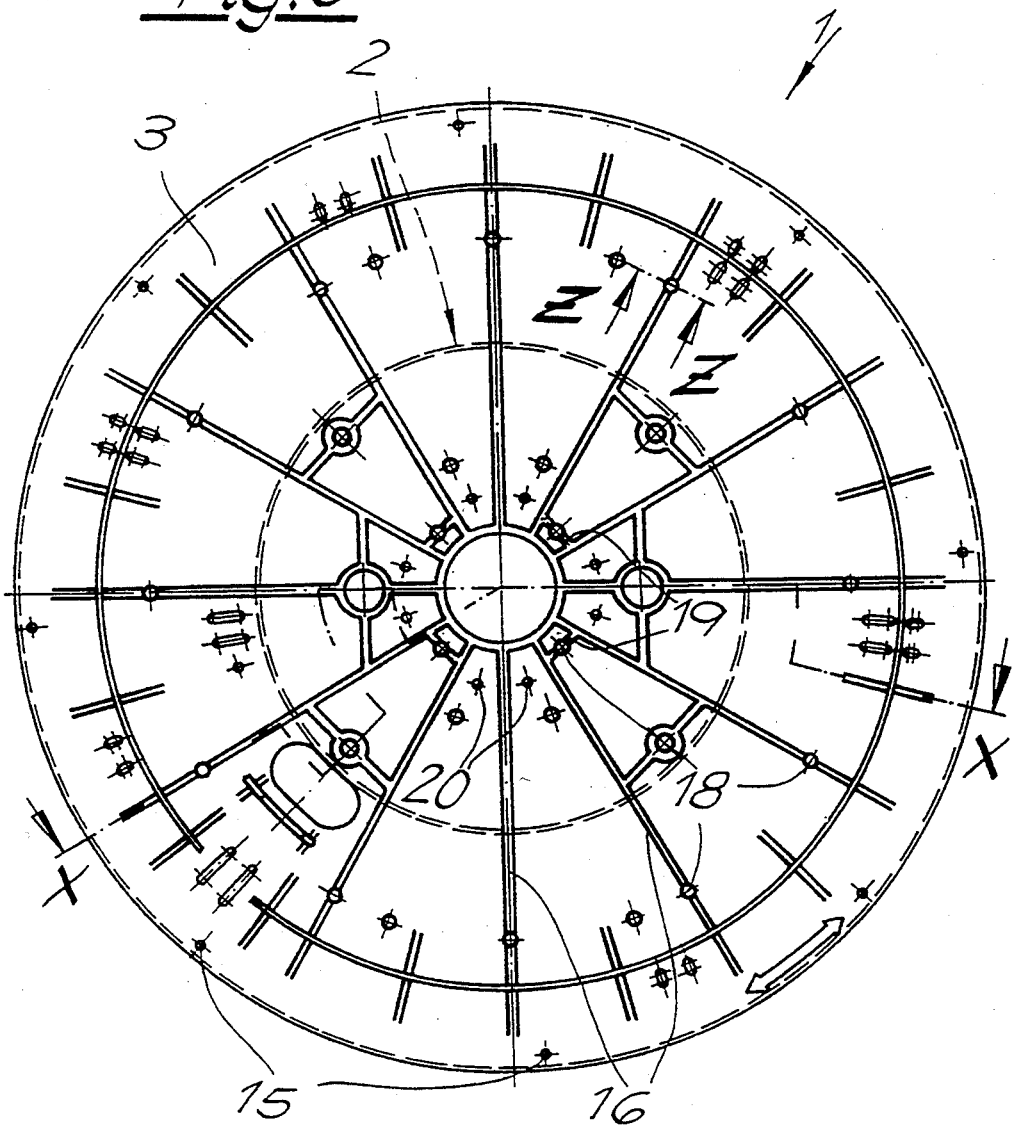
FIG. 6 is another side view of the drum in FIG. 1.
Figure 7:
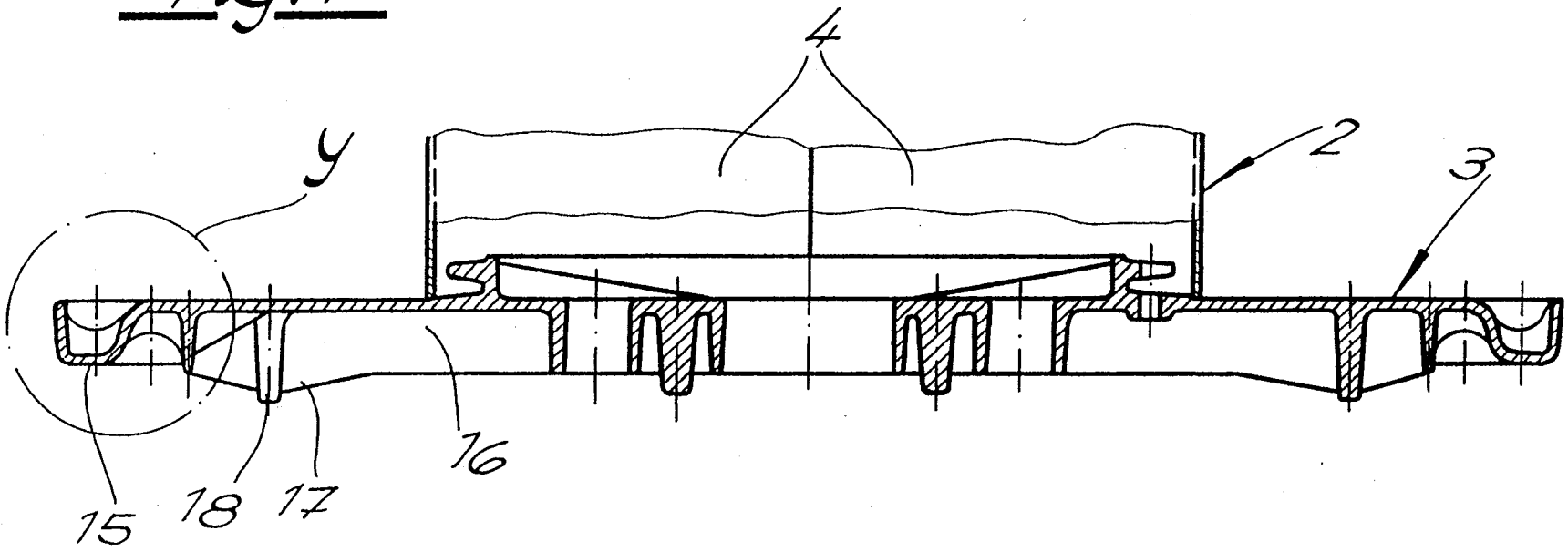
FIG. 7 is a partial section X—X through the drum in FIG. 6.
Figure 8:
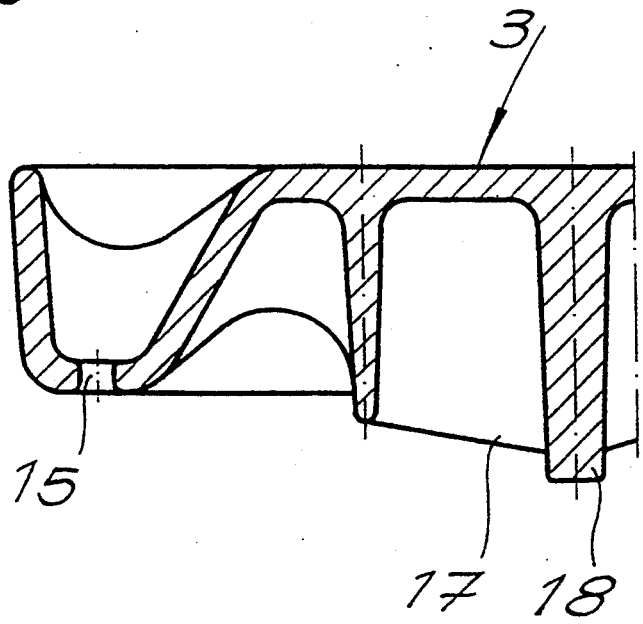
FIG. 8 is a detail Y from the drum in FIG. 7.
Figure 9:
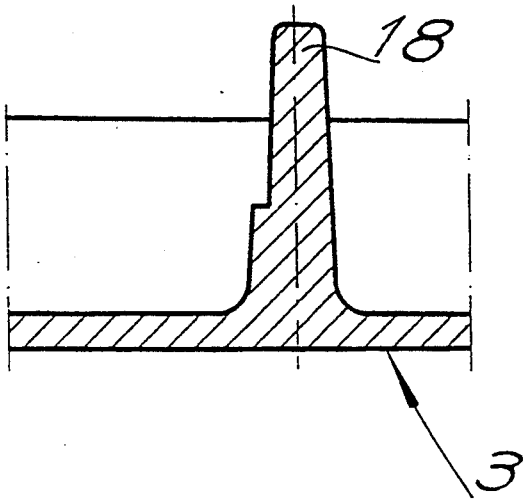
FIG. 9 is a section Z—Z of the drum in FIG. 6.

The Figures show a disassemblable cable drum 1 fabricated from a plastic material, which in its basic structure comprises a drum hub 2 and drum disks 3 on both sides of the hub. The drum disks 3 are connected by means of tie bolts (not shown) here which also clamp the drum hub 2 in between the disks. At least one of the two drum disks 3 has a cable through-aperture 5 in the region of the drum hub 2 for passing through it the starting end 6 of the cable to be reeled up. The disk 3 also comprises, externally, a cable clamping device spaced radially from the cable passage aperture 5 for fixing or attaching the starting end of the cable 6. The cable passage aperture 5 is disposed directly outside above the drum hub circumference, viewed in the axial direction, and extends in the shape of an elongated hole with a predetermined width B and length L in the circumferential direction.

The clamping device 7 is configured as a clamping rib 8 that extends in the circumferential direction with a V-shaped clamping recess 9, whose V-legs 10 comprise a barb-like set of teeth 11. The clamping rib 8 is supported by means of radially extending webs 12 and is disposed upon the drum disk 3. The V-angle $\alpha$ of the clamping recess 9 amounts preferably to 60°.

The drum disk 3 also has two cable binding or tie-off holes 13 arranged in pairs at a radial distance from the cable clamping arrangement 7. Also, pairs of cable binding penetrations 14 are provided in the edge region of at least one of the two drum disks 3, distributed across the circumference at predetermined spacings. The cable binding penetrations 13, 14 are configured as radially extending elongated holes with predetermined spacing in order to introduce cable binders and to be able to attach the starting end 6 or the terminal end of the cable in a sound manner without shortening the cable.

At least one of the two drum disks 3 comprises attachment- or nail-down holes 15 distributed across the circumference of the edge region for securing the drum in position. The drum disk 3 has furthermore at least radially extending stiffening ribs 16 with regions of greater height 17 to provide skidding- and rotational security. Furthermore, the drum disk 3 has cams 18 protruding beyond the height of the stiffening ribs 16, which also provide a skidding- and rotational security. In addition, the rib heightened regions 17 and the cams 18 serve to place the cable drums 1 in an elevated position. The cams 18 are at least partially integrated into the stiffening ribs 16. Furthermore, the cams 18 are partially integrated into stiffening webs 19 connecting the radial stiffening ribs 16 in the circumferential direction. Additionally, the cams 18 can be disposed between the stiffening webs 19 and the stiffening ribs 16. Over and above this, the two drum disks 3 comprise water drainage holes 20 — or bores viewed in axial projection within the hub region, in order to for example assure the drainage of rainwater from the core region.

While the invention has been illustrated and described as embodied in a cable drum, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. A cable drum, comprising:

a drum hub;

two drum discs, located on opposite axial sides of said drum hub, wherein at least one of said two drum discs has a cable passage aperture in a region thereof, which coincides with a plane of said drum hub, for passing a start end of a cable to be reeled-up on said cable drum; and a device, which is located on the external side of said one of said two drum discs and is supported thereon in a radially spaced relationship to said cable passage aperture, for clamping the start end of the cable on said one of said two drum discs;

wherein said clamping device comprises a circumferentially extending clamping rib having two legs forming a clamping recess which, when viewed in a radial direction, has a V-shape, and wherein respective surfaces of said two legs, which define said V-shape clamping recess, have each a set of teeth thereon;

wherein each drum disc comprises external radially extending stiffening ribs having a height defining an outer surface of the disc; and wherein each rib further includes a region having a greater height than the outer surface of the disc adapted to prohibit sliding, skidding and rotating of the drum when said region engages a support surface.

2. A cable drum according to claim 1, wherein the cable passage aperture is an elongated hole with a predetermined width and length in a circumferential direction of the drum disk, and is located directly outside the circumference of the drum hub when viewed in an axial direction.

3. A cable drum according to claim 1, wherein the angle of the V-shaped clamping recess is 60°.

4. A cable drum according to claim 1, wherein the at least one drum disk has cable binding penetrations arranged in pairs and spaced radially from the cable clamping means.

5. A cable drum according to claim 4, and further comprising additional cable binding penetrations arranged in pairs and distributed at predetermined spacings around the circumference and in an edge region of at least one of the drum disks.

6. A cable drum according to one claim 5, wherein the cable binding penetrations are radially extending elongated holes with a respectively predetermined spacing from one another.

7. A cable drum according to claim 1, wherein at least one of the two drum disks comprises attachment holes distributed across the circumference of the drum disk in an edge region so as to facilitate securing the drum in place.

8. A cable drum according to claim 1, wherein the drum disks further comprise external cams that protrude beyond the height of the stiffening ribs so as to further prohibit sliding or rotating.

9. A cable drum according to claim 8, wherein the cams are at least partially integrated into the stiffening ribs.

10. A cable drum according to claim 8, wherein the cams are partially integrated into stiffening webs that connect the radial stiffening ribs in a circumferential direction of the drum disk.

11. A cable drum according to claim 8, wherein the cams are disposed between stiffening webs that connect the radial stiffening ribs in a circumferential direction and the stiffening ribs.

12. A cable drum according to claim 8, wherein the cams are partially integrated into stiffening webs that connect the radial stiffening ribs in a circumferential direction of the drum disk, and are disposed between the stiffening webs and stiffening ribs.

13. A cable drum according to claim 1, wherein the two drum disks, viewed in an axial direction, have water drainage holes within a region of the hub.

* * * * *